United States Patent [19]

Geistert et al.

[11] 4,303,499

[45] Dec. 1, 1981

[54] PROCESS FOR THE PRODUCTION OF A TRANSFORMER OIL

[75] Inventors: Walter Geistert, Hamburg; Ulrich Krämer, Buchholz; Gottfried Klippel, Aumühle, all of Fed. Rep. of Germany

[73] Assignee: Deutsche Texaco Aktiengesellschaft, Hamburg, Fed. Rep. of Germany

[21] Appl. No.: 10,873

[22] Filed: Feb. 9, 1979

Related U.S. Application Data

[63] Continuation of Ser. No. 830,293, Sep. 2, 1977, abandoned.

[30] Foreign Application Priority Data

Sep. 11, 1976 [DE] Fed. Rep. of Germany ..... 2641055

[51] Int. Cl.[3] ..... C10G 73/02

[52] U.S. Cl. ..... 208/33; 252/575; 585/13

[58] Field of Search ..... 208/14, 19, 177, 33; 252/575

[56] References Cited

U.S. PATENT DOCUMENTS

| | | | |
|---|---|---|---|
| 3,093,576 | 11/1963 | Campbell | 208/19 |
| 3,627,673 | 12/1971 | Sproule et al. | 208/14 |
| 4,033,854 | 7/1977 | Ohmoriu et al. | 208/14 |

FOREIGN PATENT DOCUMENTS

| | | | |
|---|---|---|---|
| 589150 | 6/1947 | United Kingdom | 208/14 |

*Primary Examiner*—Delbert E. Gantz
*Assistant Examiner*—William Leader
*Attorney, Agent, or Firm*—Carl G. Ries; Robert A. Kulason; James J. O'Loughlin

[57] ABSTRACT

A process is provided for the production of a stable, age-resisting mineral oil composition which comprises subjecting a paraffin base mineral crude oil to distillation to produce a distillate fraction boiling in the range of 270° to 400° C., solvent dewaxing said distillate fraction, solvent extracting said dewaxed distillate portion to produce a solvate fraction and an extract fraction, refining said solvate fraction, concentrating and refining said extract fraction and adding said refined, concentrated extract portion with said refined solvate fraction.

7 Claims, No Drawings

PROCESS FOR THE PRODUCTION OF A TRANSFORMER OIL

This is a continuation, of application Ser. No. 830,293 filed Sept. 2, 1977, now abandoned.

BACKGROUND OF THE INVENTION

It is known to separate distillate fractions from crude oils and by refining to free from components which impair colour, storage stability or aging stability or other properties essential to the purpose for which they are to be used. Known refining processes for separating off such undesirable components provide means for treating the distillate fractions with a selective solvent for aromatic hydrocarbons, such as furfurol, liquid $SO_2$, phenol, N-methyl pyrrolidone, tetramethylene sulphone and the like; this treatment yields a purified solvate and an extract containing the undesirable components. In general, such solvates are further purified by treating them with concentrated sulphuric acid and adsorption agents, such as bleaching earth, after which they are usually termed raffinates. These refining processes can also be replaced, or supplemented, by hydrogating the distillate fractions or solvents usually in the presence of carrier catalyst under low to higher severity operation conditions. Furthermore, paraffin-rich distillate fractions are dewaxed prior to or after refining until a certain pourpoint has been reached, usually by dissolving the distillate or solvate in a solvent mixture, cooling this solution to at least the desired pourpoint, separating off the thereby deposited paraffin crystals and finally by separating and recovering the solvent mixture from the filtrate. With the aid of the refining process which has been generally described in the aforegoing, different mineral oil products, e.g. lubricating oils and transformer or electro-insulating oils, may be produced from distillate fractions of a suitable boiling range. The production of electro-insulating oils which are used for filling transducers, switches and transformers (herein after called transformer oils) according to the known refining processes, however, leads to difficulties since high demands are made of such transformer oils by the VDE specifications (Association of German Electrical Engineers) No. 0370/10.66 or DIN No. 51 507. The most important of the required values are as follows:

| | | |
|---|---|---|
| Density, gr/ml at 15° C. | max. | 0.890 |
| Kinematic viscosity, cst | | |
| at 20° C. | max. | 30 |
| at −30° C. | max. | 1800 |
| Flashpoint (top dead centre according to Marcusson), °C. | min. | 140 |
| Corrosive sulphur | | 0 |
| Neutralization No., mg KOH/g | | 0 |
| Loss angle, tan | max. | $. 10^{-3}$ |
| Baader aging test (DIN 51 554) 28 hours at 95° C. | | |
| Saponification No., mg KOH/g | max | 0.60 |
| Loss angle, tan | max | $200 . 10^{-3}$ |
| Sludge content, % by wt. | max | 0.05 |

The international valid specifications for transformer oils as well as a few problems concerning their production are explained in more detail in the journal "Electrotechnik und Maschinenbau" (*Electrical Engineering and Mechanical Engineering),* 1971, No. 7, pages 290 to 300. In view of the high requirements which are particularly made of the aging stability of transformer oils, the distillate fractions must be subjected to high-severity operation. In the course of this operation, natural anti-oxidants which are contained in many distillate fractions, pass with the undesirable components into the extract.

THE PRIOR ART

The German Offenlegungschfirt No. 20 49 050 describes insulating oils which are composed of several fractions of different crude oils. The individual fractions each require different methods of refining and differ from one another in a particular manner with regard to their aromatics content. In addition, 2,6-di-tert.-butyl-4-methylphenol as a synthetic oxidation inhibitor is added to the known insulating oil. The production of this insulating oil is complicated and costly and its preferred compositions require the use of naphthene base crude oils, which are scarcely obtainable anywhere in the world.

The British Pat. No. 1,255,897 relates to a process for the production of transformer oils. This process takes as its starting material mixed base crude oils and provides for through catalytic hydrogenation of the starting material, which has a viscosity of 1.5 to 6 cst at 99° C., subsequent fractionation of the hydrogenation product, dewaxing and finally further purification with adsorption agents, such as bleaching earth. By catalytic hydrogenation, undesirable O—, N— and S—containing components are removed, whereas the natural anti-oxidants contained in the starting material are retained in the form of hydrogenation products which first become effective in the course of aging.

The German Pat. No. 1,239,424 describes the use of an insulating oil in the form of a catalytically hydrogenated mineral oil fraction, optionally treated with sulphuric acid and the usual absorption agents. This insulating oil is obtained from fractions preferably boiling in the range of light lubricating oils, in particular spindle oils, preferably naphthenic crude oils, by mild, selective, catalytic hydrogenation treatment. It is stated in this German Patent that the hydrogenation product can be extracted optionally with one of the known solvents, preferably with liquid $SO_2$ at 20° to 35° C. and with 50 to 300 vol. % $SO_2$ in order to increase the aging stability of the insulating oil.

Finally, the German Auslegeschrift No. 1,745,771 describes the use of extract components from spindle oil and machine oil fractions recovered according to the German Auslegeschriften Nos. 1,214,349 and 1,233,091 by low temperature decomposition of high-aromatics oil extracts as a means for improving the aging stability of electro-insulating oils. These extract components were added to so-called base oils in amounts of 0.5 to 5%. The effectiveness of the extract components on the aging stability of the product increased with their molecular weight and their iodine number. The first should be in the range of 250 to 400, and the latter in the range of 15 to 25. As can be seen from the German Auslegeschrift No. 1,214,349, however, the extracts forming in the extraction plants constitute a starting material little suited to recover mineral oil-specific aging substances, as their composition varies and their properties are unfavourable. For this reason, the extract obtained when refining spindle oil or lubricating oil is first distilled in vacuo according to the process of the German Auslegeschrift No. 1,214,349, the distillation residue being discarded. According to the processes of the German Auslegeschriften Nos. 1,214,349 or 1,223,091, the distillate of this extract is thereafter divided into different fractions by fractionating crystallization at low temperatures. A high-aromatic fraction is again fractionated by vacuum distillation and one of the resultant fractions further purified by catalytic hydrogenation and finally used as a means for improving the aging stability of electro-insulating oils.

SUMMARY OF THE INVENTION

The object of the present invention is to improve the known processes for producing age-resistant mineral oil fractions, in particular standard-conforming transformer oils, by solvent refining crude oil distillate fractions and to produce such transformer oils from easily accessible, low-priced crude oils.

In contrast to the hitherto customary mode of operation, the process of the invention proceeds from a paraffin base crude oil, for example "Arabian light", from which a distillate fraction is separated off that boils in the range of 270 to 400, in particular 300° to 355° C., and that has a viscosity of 6 to 25 cst, in particular 10 to 12 cst, at 20° C. and a flash point according to Marcusson of at least 140° C. and that is dewaxed according to one of the usual processes. It is sometimes expedient to perform this dewaxing prior to refining of the distillate fraction, but this order can also be reversed. The optionally dewaxed filtrate of the distillate fraction is thereafter refined by solvent refining known per se with a solvent selective towards aromatic hydrocarbons, both a solvate and an extract being thereby obtained. This solvent refining is performed according to one of the embodiments of the inventive process described of the inventive process described in the following in such a manner that by treating the resultant solvate in the usual way with concentrated sulphuric acid, adsorption agents, such as bleaching earth, or by subjecting the solvate to mild catalytic hydrogenation, a raffinate is obtained which complies with all the DIN No. 51 507 specification. According to one of the embodiments of the process of the invention a concentrate is produced from the extract of solvent refining which is added to the raffinate in small amounts and which considerably improves its aging stability.

SPECIFIC EMBODIMENTS OF THE INVENTION

The process of the invention can be performed with all selective solvents known thereof. Of these solvents there are preferred liquid sulphur dioxide or furfurol. In the first embodiment of the invention which is explained in Example 1, solvent refining is performed in such a manner that about 80% by weight of solvate and about 20% by weight of extract is obtained.

According to a second embodiment which is explained in Example 2, the dewaxed filtrate of the distillate fraction employed is divided into a first part amounting to about 45 % by wt. and a second part amounting to about 55% by wt. Both parts are extracted separately with the selective solvent in such a manner that the first part yields about 85% by wt. of solvate and about 15% by wt. of extract and the second part about 70% by wt. of solvate as well as 30% by wt. of extract. The solvates of the first and second part are combined and purified together to form a raffinate. The concentrate is produced from the extract amounting to 15% by wt. of the first part in such a way that this part of the extract is concentrated by distillation under reduced pressure to a residue of about 20 vol. % and this residue is further purified. As in the case of the solvate, the residue can be purified by treating with small amounts of concentrated sulphuric acid and bleaching earth. Another particularly effective method of recovering a purified extract concentrate consists in that the extract residue, optionally pretreated with concentrated sulphuric acid and bleaching earth, is diluted with an inert solvent, in particular petroleum ether and this solution then extracted with an aqueous mineral acid, in particular concentrated hydrochloric acid. The acidic aqueous extract is then neutralized and treated with an inert, low-boiling solvent, in particular petroleum ether. After evaporation of the solvent, a highly effective extract concentrate is obtained of which amounts of 0.001 to 0.1% by weight in the raffinate will suffice to meet the requirements of modern high-power transformers, there requirements far exceeding the DIN 51 507 specifications. As was ascertained, this highly effective extract concentrate contains organic nitrogen compounds in amounts of about 3 to 8% by wt. These compounds are evidently decisive for the extremely high anti-oxidizing effect of the extract concentrate which is revealed by the Examples.

According to the improved process of the invention, mineral oil fractions and in particular transformer oils can be obtained which by virtue of the paraffin base starting material have excellent age stability as well as relatively low densities and low viscosities at 20° C. and in particular at −30° C. These properties considerably improve heat dissipation and the cooling effect of transformer oils. Furthermore, their flash point lies quite considerably above the minimum value required by DIN No. 51 507 and the process of the invention is simpler and less complex that the hitherto known methods of operation.

The different embodiments of the process of the invention are explained in further detail in the following Examples.

EXAMPLE I

A distillate is used which has been separated off from "Amna" crude oil. It has the following properties:

| | |
|---|---|
| Boiling range, °C. | 270–313 |
| Density, gr./ml at 15° C. | 0.847 |
| Flash point, °C. | |
| according to Pensky-Martens (PM) | 132 |
| according to Marcusson | 142 |
| Viscosity, cst at 20° C. | 6.8 |
| Pourpoint according to DIN 51 597, °C. | 0 |

The distillate is extracted with 70 parts by volume of liquid $SO_2$ per 100 parts by volume of distillate at 20° C. and yields 80% by weight of a solvate and 20% by weight of an extract.

The resultant solvate has the following physical data:

| | |
|---|---|
| Density, gr/ml at 15° C. | 0.820 |
| Flash point, °C. | |
| according to Pensky-Martens | 133 |
| according to Marcusson | 144 |
| Viscosity, cst at 20° C. | 6.5 |

This solvate is dissolved in a mixture of 40% by weight of dichloro-ethane and 60% by weight of methylene chloride in the ratio of 300 parts by volume of the solvent mixture per 100 parts by volume of the solvate, this solution cooled and freed from the paraffins which separate off in the form of crystals by filtering at a temperature of −42° C. The amount of crude paraffin which separates off amounts to about 15% by weight based on the solvate used.

The dewaxed solvate has the following properties after evaporation of the solvate mixture:

| | |
|---|---|
| Density, gr./ml at 15° C. | 0.825 |
| Flash point (PM), °C. | 134 |
| according to Marcusson, °C. | 145 |
| Viscosity, cst at 20° C. | 6.7 |
| cst at −30° C. | 96.2 |
| Pourpoint according to DIN 51 597, °C. | −42 |

The dewaxed solvate is treated twice each time with 2% by weight of concentrated sulphuric acid, neutralized with aqueous NaOH and thereafter purified with 2% by weight of activated bleaching earth.

By distillation at a pressure of about 1 mm Hg, 85 vol. % of the extract material is separated off from the extract resulting from the $SO_2$ extraction. The residue amounting to 15 vol. % of the extract material is treated with 0.5% by weight of a 96% strength sulphuric acid and thereafter with 1.5% by weight of activated bleaching earth.

The thus purified extract concentrate is added to the raffinate in an amount of 0.5% by weight. The properties of this mixture and of the raffinate are given in Table I below:

TABLE 1

| | Raffinate | Mixture |
|---|---|---|
| Colour (ASTM) | L 0.5 | L 0.5 |
| Density, gr./ml at 15° C. | 0.824 | 0.824 |
| Flash point (PM), °C. | 134 | 134 |
| according to Marcusson, °C. | 144 | 144 |
| Viscosity, cst at 20° C. | 6.7 | 6.7 |
| cst at −30° C. | 95.3 | 95.8 |
| Corrosive sulphur | free | free |
| Neutralization No., mg of KOH/gr. | 0 | 0 |
| Baader aging test (140 hrs/110° C.) | | |
| Saponification No. | 0.50 | 0.26 |
| tan | 0.160 | 0.055 |
| Sludge, % by wt. | 0.04 | 0.02 |

EXAMPLE 2

A distillate is used which has been separated off from "Arabian light" crude oil. It has the following properties:

| | |
|---|---|
| Boiling Range, °C. | 300–355 |
| Density, gr./ml at 15° C. | 0.865 |
| Flash point according to PM, °C. | 150 |
| according to Marcusson, °C. | 160 |
| Pourpoint according to DIN 51 597, °C. | +5 |
| Viscosity, cst at 20° C. | 11.9 |

This distillate is dissolved in a mixture consisting of 40% by weight of dichloro-ethane and 60% by weight of methylene chloride in the rate of 260 parts of volume of the solvent mixture per 100 parts by volume of distillate this solution cooled and freed from the paraffins which separate off in the form of crystals by filtering at a temperature of −40° C. The amount of crude paraffins which separates off amounts to about 18% by weight, based on the distillate used.

The dewaxed filtrate has the following properties (after evaporation of the solvent mixture):

| | |
|---|---|
| Density, gr./ml at 15° C. | 0.881 |
| Flash point according to PM, °C. | 150 |
| according to Marcusson, 20° C. | 161 |
| Pourpoint according to DIN 51 597, °C. | −43 |
| Viscosity, cst at 20° C. | 13.2 |
| cst at −30° C. | 290 |

The dewaxed filtrate is divided into a 1st part amounting to 45% by wt. and a 2nd part amounting to 55% by wt. Both parts are individually extracted with liquid $SO_2$ under the following conditions:

The 1st part is treated with 50 parts by volume per 100 parts by volume of filtrate at 25° C. and yields 85% by weight of a 1st solvate and 15% by weight of a 1st extract.

The 2nd part is extracted with 115 parts by volume of $SO_2$ per 100 parts by volume of filtrate at 30° C. and yields 70% by wt. of a 2nd solvate and 30% by weight of a 2nd extract.

Solvates 1 and 2 are combined and twice treated each time with 2.5% by wt. of concentrated sulphuric acid (96%), neutralized with NaOH and thereafter purified with 2% by wt. of activated bleaching earth.

80 vol. % of the extract material is separated off from the 1st extract which constitutes 15% by wt. of the 1st part of the dewaxed filtrate by means of distillation at a pressure of about 1 mm Hg. Extract concentrates are produced in the following manner from the residue of the vacuum distillation, this residue amounting to about 20 vol. % of the extract material.

(a) A part of the extract residue is treated with 0.75% by wt. of a 96% strength sulphuric acid and thereafter with 2% by wt. of activated bleaching earth. The thus purified extract concentrate is added to the combined raffinates in an amount of 0.8% by weight. The properties of this mixture, termed product A, can be seen in Table 2.

(b) Another part of the extract residue is diluted with petroleum ether and the solution extracted with concentrated aqueous hydrochloric acid. The hydrochloric aqueous extract is neutralized with NaOH and treated with petroleum ether. After drying the evaporation of the petroleum ether extract, there remains an extract concentrate B, which is added to the combined raffinates in an amount of 0.006% by weight. The properties of this mixture, termed product B, can be seen from Table 2.

TABLE 2

| Properties: | Raffinates | Product A (Raffinates + 0.8% by wt. of extract concentrate A) | Product B (Raffinates + 0.006% by wt. of extract concentrate B) |
|---|---|---|---|
| Colour (acc. to ASTM) | L 0.05 | 0.5 | L 0.5 |
| Density, gr./ml at 15° C. | 0.847 | 0.848 | 0.847 |
| Flash Point (PM), °C. | 150 | 150 | 150 |
| Viscosity cst at 20°C. | 11.8 | 12.0 | 11.8 |
| at −30° C. | 208 | 210 | 208 |
| Neutralization No., mg KOH/gr. | 0 | 0 | 0 |
| Loss angle, tan | 0.0008 | 0.001 | 0.001 |
| Sulphur corrosion | free | free | free |
| Baader aging test | | | |

TABLE 2-continued

| Properties: | Raffinates | Product A (Raffinates + 0.8% by wt. of extract concentrate A) | Product B (Raffinates + 0.006% by wt. of extract concentrate B) |
|---|---|---|---|
| (140 hr at 110° C. mod. acc. to DIN 51 554): | | | |
| Saponification No., mg KOH/gr. | 0.58 | 0.28 | 0.20 |
| tan | 0.130 | 0.065 | 0.045 |
| Sludge, % by wt. | 0.045 | 0.02 | 0.01 |

The following amounts of nitrogen compounds (determined according to Dumas) were found in the individual stages:

| | % by wt. of N |
|---|---|
| Distillate fraction used | 0.0155 |
| 1st extract (15% by wt. of the 1st part of the distillate fraction) | 0.055 |
| Vacuum residue (20 vol. % of the 1st extract) | 0.26 |
| Extract concentrate from the hydrochloric extract of the vacuum residue of the 1st extract | 5.5 |

EXAMPLE 3

A distillate from "Arabian light" crude oil separated and dewaxed in accordance with Example 2 is divided into two parts, each of which covers 50% by wt. Both parts are extracted with furfurol under the following conditions.

The 1st part is treated with 80 parts by volume of furfurol per 100 parts by volume of distillate at 85° C. and yields 83% by wt. of a 1st solvate and 17% by wt. of a 1st extract.

The 2nd part is extracted with 110 parts by volume of furfurol per 100 parts by volume of filtrate at 92° C. and yields 67% by wt. of a 2nd solvate and 33% by wt. of a 2nd extract.

The 1st and 2nd solvates are combined and subjected to hydrogenation treatment in the presence of a nickel/-molybdenum catalyst. The hydrogen partial pressure amounts to 40 mm Hg, the reactor temperature to 250° C. and the space velocity to 0.5 l/l of catalyst per hour.

85 vol. % of the extract is separated off from the extract of the 1st part by distillation at a pressure of about 1 mm Hg. From the residue, which amounts to 15 vol. % of the extract material, an extract concentrate is obtained by means of hydrogenation treatment at a hydrogen partial pressure of 25 mm Hg, a reactor temperature of 220° C. and a space velocity of 0.5 l/l of catalyst per hour and subsequent treatment with 0.5% by weight of bleaching earth.

0.5% by weight of the thus refined extract concentrate is added to the raffinate obtained by hydrogenation treatment. The properties of this mixture are given in Table 3.

TABLE 3

| Properties | Raffinates | Mixtures (raffinates + 0.5% by wt. of extract concentrate) |
|---|---|---|
| Colour (ASTM) | L 0.5 | L 0.5 |

TABLE 3-continued

| Properties | Raffinates | Mixtures (raffinates + 0.5% by wt. of extract concentrate) |
|---|---|---|
| Density, gr./ml 15° C. | 0.846 | 0.846 |
| Flash Point (PM), °C. | 148 | 148 |
| Viscosity, cst at 20° C. | 11.5 | 11.6 |
| cst at −30° C. | 195 | 198 |
| Neutralization No., mg KOH/g | 0 | 0 |
| Loss angle tan | 0.0008 | 0.0009 |
| Sulphur corrosion | free | free |
| Baader aging test (140 hr at 110° C. mod. acc. tp DIN 51 554): | | |
| Saponification No.- mg KOH/g | 0.54 | 0.22 |
| tan | 0.125 | 0.070 |
| Sludge, % by wt. | 0.040 | 0.025 |

According to the process of the invention, it is possible to produce age-resistant mineral oil fractions and in particular transformer oils which fully meet, and in some respects far more than meet, the requirements of DIN No. 51 507. At the same time the process according to the invention is considerably simpler and far more economic than the known processes, since high-quality transformer oils can be obtained from moderately priced, abundantly available distillates of paraffin base crude oils.

An important element in the process of the invention is the novel recovery of the mineral oil-specific anti-oxidant from the distillate fraction itself, that is from a solvent extract obtained therefrom in a manner known per se. An extract concentrate is obtained as the residue in this recovery by concentration of the solvent extract in vacuo. This concentrate has proved to be a very effective, mineral oil-specific anti-oxidant and can be added again to the solvent raffinate of the distillate fraction employed. By extraction with an acid, however, it is possible to obtain from the extract concentrate a far more effective mineral oil-specific anti-oxidant which contains at least about 3% by weight of nitrogen in bonded form. It is particularly advantageous that both the production of high-quality transformer oils as well as the recovery of these extract concentrates can be performed in a conventional plant for solvent refining crude oil distillates and require neither substantial reconstruction of this plant nor any additional outlay worth mentioning.

We claim:

1. A method for preparing a stable age-resisting mineral oil composition which comprises subjecting a nitrogen-containing paraffin base crude petroleum to distillation to produce a distillate fraction boiling in the range of about 270° to 400° C. having a viscosity in the range of 6 to 25 cst and a flashpoint of at least 130° C., subjecting said distillate fraction to solvent extraction with a solvent selective for aromatic hydrocarbons to produce:

(a) a solvate consisting of at least about 70% of said distillate fraction, and (b) an extract fraction, subjecting said solvate "a" to refining to produce a refined raffinate fraction, subjecting said extract fraction "b" to vacuum distillation to produce a nitrogen-containing extract concentrate residue consisting of from about 10 to 20 volume percent of said extraction fraction "b", containing from 3 to 8 percent by weight nitrogen, and adding said nitrogen-containing extract concentrate residue to said raffinate fraction to produce a stable age-resisting mineral oil comprising from about 0.0001 to 5 weight percent of said nitrogen-containing extract concentrate residue and the balance said raffinate fraction.

2. A method according to claim 1 in which said extract concentrate residue is added to said raffinate fraction in the amount of 0.25 to 3 weight percent.

3. A method according to claim 1 in which said extract concentrate residue is refined to produce a refined, extract concentrate, dissolving said refined extract concentrate residue in an inert solvent to produce an extract concentrate solution, treating said extract concentrate solution with an aqueous mineral acid, neutralizing said extract concentrate solution and recovering from said solution a nitrogen-containing extract concentrate.

4. A process according to claim 3 in which both said solvate and said extract concentrate residue are refined by one or more of the steps of treating with concentrated sulfuric acid, activated bleaching earth or hydrogenation.

5. A method according to claim 1 in which said solvate is solvent dewaxed.

6. A method according to claim 1 in which said distillate fraction is solvent dewaxed.

7. A method for preparing a stable, age-resisting mineral oil composition which comprises subjecting a nitrogen-containing paraffin base crude petroleum to distillation to produce a distillate fraction boiling in the range from about 270° to 400° C., having a viscosity in the range of 6 to 25 cst and a flashpoint of at least 130° C., subjecting said distillate fraction to solvent dewaxing to produce a dewaxed distillate fraction, subjecting said dewaxed distillate fraction to solvent extraction with liquid $SO_2$ or furfural to produce:

(a) a solvate consisting of 80 to 85% of said dewaxed distillate fraction, and (b) an extract fraction, subjecting said solvate "a" to refining to produce a refined, dewaxed raffinate fraction, subjecting said extract fraction "b" to vacuum distillation to produce a nitrogen-containing extract concentrate residue consisting of from about 10 to 20 volume percent of said extract fraction "b", refining said extract concentrate to produce a refined, extract concentrate residue, dissolving said refined extract concentrate residue in an inert solvent to produce an extract concentrate solution, treating said extract concentrate solution with an aqueous mineral acid, neutralizing said extract concentrate solution and recovering from said solution an extract concentrate containing from 3 to 8 percent by weight of nitrogen and adding said refined extract concentrate containing from 3 to 8 percent nitrogen to said raffinate fraction to produce a stable, age-resisting mineral oil comprising from about 0.25 to 3 weight percent of said refined extract concentrate and the balance said raffinate fraction.

* * * * *